US010543964B2

(12) United States Patent
Mortensen

(10) Patent No.: US 10,543,964 B2
(45) Date of Patent: Jan. 28, 2020

(54) CONTAINER WITH A LID AND A SECURING RING

(71) Applicant: BALTIC PACKAGING A/S, Kastrup (DK)

(72) Inventor: Jan Mortensen, Dragor (DK)

(73) Assignee: BALTIC PACKAGING A/S, Kastrup (DK)

( * ) Notice: Subject to any disclaimer, the term of this patent is extended or adjusted under 35 U.S.C. 154(b) by 43 days.

(21) Appl. No.: 15/513,303

(22) PCT Filed: Feb. 3, 2015

(86) PCT No.: PCT/DK2015/050024

§ 371 (c)(1),
(2) Date: Mar. 22, 2017

(87) PCT Pub. No.: WO2016/045676

PCT Pub. Date: Mar. 31, 2016

(65) Prior Publication Data

US 2017/0305617 A1 Oct. 26, 2017

(30) Foreign Application Priority Data

Sep. 24, 2014 (DK) ..... 2014 70589

(51) Int. Cl.
*B65D 45/32* (2006.01)
*B44D 3/12* (2006.01)
(Continued)

(52) U.S. Cl.
CPC ..... *B65D 45/32* (2013.01); *B44D 3/127* (2013.01); *B65D 25/32* (2013.01); *B65D 43/021* (2013.01);
(Continued)

(58) Field of Classification Search
CPC ..... B65D 2543/00462; B65D 2543/00972; B65D 43/0206; B65D 45/30; B65D 43/021; B65D 43/022; B44D 3/127
See application file for complete search history.

(56) References Cited

U.S. PATENT DOCUMENTS 2,001,748 A * 5/1935 Saalbach ..... B65D 43/022 220/319
3,469,735 A * 9/1969 Burt ..... B65D 25/50 220/698
(Continued)

FOREIGN PATENT DOCUMENTS

AU 2013100421 5/2013
DE 687540 1/1940
(Continued)

OTHER PUBLICATIONS

International Search Report for PCT/DK2015/050024, completed by the European Patent Office dated Apr. 29, 2015, All together 4 Pages.
(Continued)

*Primary Examiner* — Mollie Impink
(74) *Attorney, Agent, or Firm* — Brooks Kushman P.C.

(57) ABSTRACT

A container includes a container body and a lid, which has an outer lid wall portion surrounding a central portion. The outer lid wall portion provides a lid-side sealing surface, which engage with body-side sealing surface, when the lid is applied to the container body to close the container. The container further includes a securing ring inserted within the outer lid wall portion. The securing ring having a lower portion and an upper flange portion extending from the lower portion at an acute angle (α) of less than 80° from vertical.

19 Claims, 3 Drawing Sheets

Figure 1:
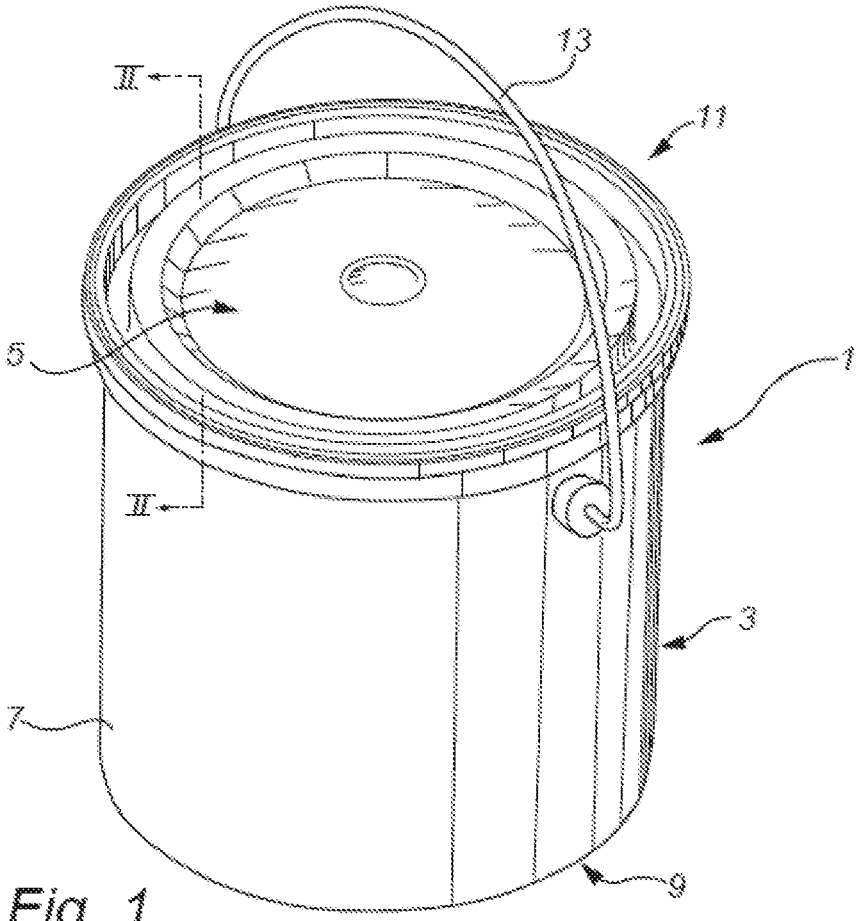
Fig. 1 Prior Art

(51) Int. Cl.
*B65D 25/32* (2006.01)
*B65D 43/02* (2006.01)

(52) U.S. Cl.
CPC ..... *B65D 2543/0062* (2013.01); *B65D 2543/00092* (2013.01); *B65D 2543/00277* (2013.01); *B65D 2543/00435* (2013.01); *B65D 2543/00509* (2013.01); *B65D 2543/00546* (2013.01); *B65D 2543/00685* (2013.01); *B65D 2543/00768* (2013.01); *B65D 2543/00796* (2013.01); *B65D 2543/00972* (2013.01)

(56) References Cited

U.S. PATENT DOCUMENTS

| | | | | |
|---|---|---|---|---|
| 4,002,516 | A | 1/1977 | Gaborieau et al. | |
| 4,358,024 | A | 11/1982 | Underwood | |
| 4,574,974 | A | 3/1986 | Von Holdt | |
| 4,728,003 | A | 3/1988 | Davey | |
| 4,969,570 | A | 11/1990 | Harvey, Sr. | |
| 5,161,689 | A * | 11/1992 | Balson | B44D 3/127 206/508 |
| 5,181,626 | A * | 1/1993 | Daenen | B65D 43/021 220/203.09 |
| 5,193,705 | A | 3/1993 | McCallum et al. | |
| 5,967,363 | A * | 10/1999 | Allen | B44D 3/128 220/701 |
| 7,617,946 | B2 | 11/2009 | Loerop et al. | |
| 2003/0141311 | A1* | 7/2003 | Ceolin | B65D 43/0206 220/701 |
| 2004/0232150 | A1 | 11/2004 | John P. et al. | |
| 2007/0045330 | A1* | 3/2007 | McFadyen | B44D 3/127 220/793 |
| 2007/0289984 | A1 | 12/2007 | Kloss et al. | |
| 2013/0068766 | A1 | 3/2013 | Johansson et al. | |
| 2013/0334240 | A1* | 12/2013 | Alvares | B65D 43/0249 220/780 |

FOREIGN PATENT DOCUMENTS

| | | |
|---|---|---|
| DE | 3122982 | 12/1982 |
| DE | 3339777 | 5/1984 |
| EP | 0246783 | 11/1986 |
| EP | 0383745 | 2/1992 |
| EP | 0292462 | 5/1992 |
| EP | 1332976 | 8/2003 |
| EP | 1495980 | 1/2005 |
| EP | 1728648 | 12/2006 |
| EP | 2155578 | 9/2012 |
| NL | 9300900 | 9/1993 |
| WO | 9204248 | 3/1992 |
| WO | 9632335 | 10/1996 |
| WO | 9835882 | 8/1998 |
| WO | 2006032539 | 3/2006 |
| WO | 2008156420 | 12/2008 |
| WO | 2009055892 | 5/2009 |
| WO | 2011041826 | 4/2011 |
| WO | 2013041226 | 3/2013 |
| WO | 2014134661 | 9/2014 |

OTHER PUBLICATIONS

Danish Patent and Trademark Office Search Report for Application No. PA 2014 70589, dated Apr. 29, 2015, 2 Pages.

* cited by examiner

CONTAINER WITH A LID AND A SECURING RING

CROSS-REFERENCE TO RELATED APPLICATION

This application is the U.S. national phase of PCT Application No. PCT/DK2015/050024 filed on Feb. 3, 2015, which claims priority to DK Patent Application No. PA 2014 70589 filed on Sep. 24, 2014, the disclosures of which are incorporated in their entirety by reference herein.

The present invention relates to a container comprising a container body and a lid, said container body having a bottom, a side wall and an opening at a top opposite the bottom, said opening having a closing area with a body-side sealing surface, said lid having a central portion and an outer lid wall portion, said outer lid wall portion being circumferential and surrounding the central portion, a rim portion and an annular ledge being provided at an upper end of said outer lid wall portion, said outer lid wall portion providing on an outer side thereof a lid-side sealing surface, said lid-side sealing surface engaging with said body-side sealing surface, when the lid is applied to the opening of the container body to close the container, the container further comprising a securing ring inserted within said outer lid wall portion, said securing ring comprising a lower portion accommodated within the outer lid wall portion, said lower portion having as an outer portion a third securing portion.

A container of this art is known from WO-A-2013/041226, which discloses a container with a securing ring completely bridging a trough portion or circumventing U-shaped track of the lid to transfer the force of a possible blow against the upper rim of the container to the central portion of the lid, thereby protecting and stiffening the upper rim of the container including the lid. Further this prior art securing ring comprises a securing portion extending around and engaging the outside of the container body to secure the position of the lid on the container body. For opening the container the securing ring is initially removed.

Containers of the above art are e.g. used for transport and storage of liquids, such as paint, some of which are classified as dangerous, and accordingly the containers used for transport and storage thereof are subject to certification. To obtain a certificate the containers e.g. has to pass certain tests i.a. drop tests, whereby filled and closed samples of a given container are dropped from a given height at a given angle and whereby the samples must not leak. E.g. samples are dropped to land obliquely on the top rim from heights e.g. above 1 m whereby due to the inertia of the liquid inside the container an impulse will act on the inside of the lid tending to force the lid off the container body.

Different means are known for securing a lid on a container body, such means including a securing rings extending around and engaging the outside of the container body to secure the position of the lid on the container body, cf. e.g. the above WO-A-2013/041226, and the provision of resilient beads at the sealing surfaces and an adhesive adhering a bead at one sealing surface to the opposite sealing surface when the lid is applied to the container body, cf. WO-A-92/04248. Some prior art securing means are applicable simultaneously and some are not.

The object of the present invention is to provide a container with alternative or additional securing means securing the lid on the container body.

This is obtained in accordance with the invention in that the securing ring further comprises an upper flange portion extending from the lower portion above the annular ledge at an acute angle of less than 80° from vertical. Hereby is obtained that the upper flange portion may act as a cushion absorbing a part of the energy from the impact if the container falls upside-down. Further an impact against the upper flange portion will tend to drive the securing ring, at the circumferential area of impact and accordingly the lid deeper down into its seat in the container body In an embodiment the invention relates to containers of the art mentioned by way of introduction, in which a body-side securing portion diverging in a downwards direction is provided at the body-side sealing surface and a lid-side securing portion diverging in the downwards direction is provided at the lid-side sealing surface, said lid-side securing portion engaging with said body-side securing portion, when the lid is applied to the opening of the container body to close the container, and said lower portion has an outer portion comprising a third securing portion.

Body-side securing portions diverging in a downwards direction and lid-side securing portions diverging in the downwards direction for securing the lid in a closed position on the container body are known in a number of embodiments e.g. provided by inwardly or outwardly protruding bulges or beads, transitions between areas of different diameters, transitions between components etc., cf. DE-A-33 39 777, WO-A-92/04248, WO-A-96/32335, WO-A-98/35882, WO-A-2006/032539, WO-A-2013/041226, et al. The present invention is not limited to special embodiments of said securing portions, if such are present.

In an embodiment of such containers said lower portion is extending at least down to, preferably beyond and below, the level of the lid-side securing portion. Hereby is obtained that the presence of the lower portion of the securing ring may reduce deformation of the closing area of the container in case of an impact due to the container falling upside-down.

In a further embodiment said third securing portion is arranged for, or is in, engagement with an inner surface of the outer lid wall portion at the level of the lid-side securing portion. Hereby is obtained an enhancement of the surface pressure of the engagement between the lid-side securing portion and the body-side securing portion.

In an embodiment combining the above mentioned embodiments a significant enhancement of the lid's resistance against an impulse tending to lift it off the container body is obtained. Thus when a container according to the invention falls obliquely on its top rim an impact against the upper flange portion will, as mentioned, tend to drive the securing ring, at the circumferential area of impact and accordingly the lid deeper down into its seat in the container body. Simultaneously, due to forces being directed by and through the security ring, the latter will at the other parts of the circumference outside the area of impact be forced harder against the inner side of the outer lid wall portion thereby enhancing the surface pressure of the engagement between the lid-side securing portion and the body-side securing portion. Both effects enhance the lid's resistance to being forced from its seat in the opening of the container body, notwithstanding the cushioning effect of the upper flange portion.

In an embodiment the acute angle is less than 70°, and in a further embodiment the acute angle is in the range 35° to 55°.

It should be understood that as used herein in relation to the container the terms "up" and "down", etc. refers to the container in a normal upright position as standing on its bottom on a horizontal support. Further the terms "in" and "inner", etc. on one hand and "out" and "outer", etc. on the other hand refer to directions towards and away from a central vertical axis of the container, respectively, said vertical axis being vertical when the container is in a normal upright position such as standing on its bottom on a horizontal support.

Either of the container body and the lid may be made, at least primarily, of sheet metal, such as sheet steel. Especially the parts of the container body providing the body-side sealing surface and the body-side securing portion and/or the parts of the lid providing the lid-side sealing surface and the lid-side securing portion may be made of sheet metal, such as sheet steel.

The first and second sealing surface, i.e. the body-side sealing surface and the lid-side sealing surface, respectively, may be annular and have vertical extends. Especially the first and second sealing surface may be substantially vertical.

In an embodiment the third securing portion extends continuous circumferentially along the inner surface of the outer lid wall portion. Such feature supports and enhances the effect of the security ring being at the other parts of the circumference outside the area of impact forced harder against the inner side of the outer lid wall portion.

In an embodiment the third securing portion comprises, or is provided by, a bead projecting outwardly from the outer portion of the lower portion of the securing ring. Such feature provides for an enhancement of the surface pressure between the lid-side securing portion and the body-side securing portion in case of an impact against the upper flange portion.

In a practical embodiment the securing ring is secured within the outer lid wall portion by engagement between the third securing portion and the inner surface of the outer lid wall portion.

In an embodiment the lower portion of the securing ring extends substantially to a horizontal wall portion adjacent the outer lid wall portion. Hereby is obtained that upon an impact against the upper flange portion the security ring may be forced into contact said horizontal wall portion to transfer force of the impact to the lid in a downwards direction.

In an embodiment the securing ring comprises an annular concave portion engaging an upturned surface portion of the ledge. Hereby is obtained that upon an impact against the upper flange portion the security ring may transfer a downwardly directed force to the lid via said ledge (adjacent the outer lid wall portion).

In a practical embodiment the upper flange portion is conical upwardly diverging and has a lower inner side connected integrally with the lower portion and a free upper outer side. Hereby is obtained that a tool for opening the container may be inserted past the free upper outer side and below the rim portion of the lid while the security ring remain positioned on the lid, and that stacking of containers is not hindered by the upper flange portion.

In an embodiment the lower portion of the securing ring fits within the outer lid wall portion with a tight fit. Hereby is obtained that the engagement between the third securing portion and the inner surface of the outer lid wall portion is constant, and the surface pressure between the lid-side securing portion and the body-side securing portion is enhanced, whereby the effect of the security ring being at the other parts of the circumference outside the area of impact forced harder against the inner side of the outer lid wall portion is supported and enhanced.

In an embodiment a circumferential trough portion comprising an inner trough wall, a trough bottom and said outer lid wall portion is surrounding the central portion of the lid. In a further embodiment the lower portion of the securing ring fits around the inner trough wall with a loose fit. Hereby is provided for the security ring to yield, at least slightly, towards the centre of the lid at the area of impact to support and enhance the effect of the security ring being at the other parts of the circumference outside the area of impact forced harder against the inner side of the outer lid wall portion, and the mounting of the security ring is facilitated In an embodiment the securing ring is recessed. Hereby is obtained a reduction of the amount of material used for the production of the security ring thus reducing costs and the security ring may be provided as a body with relatively small wall thickness which facilitates production of the security ring by injection moulding.

In an embodiment the closing area is unilateral. By a unilateral closing area a closing area should be understood, in which a single, preferably substantially vertical, body-side sealing surface is in contact with a single lid-side sealing surface. Especially a unilateral closing area should be understood as opposed to a bilateral closing area in which a closing area of the container body is provided by a U-shaped groove structure and the closing area of the lid is a likewise U-shaped groove structure, whereby the U-shaped groove structure of the lid is inserted into the U-shaped groove structure of the container body, when the lid is applied to the container body, whereby two vertical sealing surfaces of the lid, separated by the bottom of the U-shaped structure, engages with corresponding two vertical sealing surfaces of the container body. Such bilateral closing areas are e.g. known from WO 2011/041826 A1, U.S. Pat. Nos. 7,617,946 and 4,728,003.

In an embodiment the securing ring is a permanent securing ring. By permanent securing ring a securing ring should be understood that may remain seated on the lid when the container is opened by the lid being removed.

Figure 2:
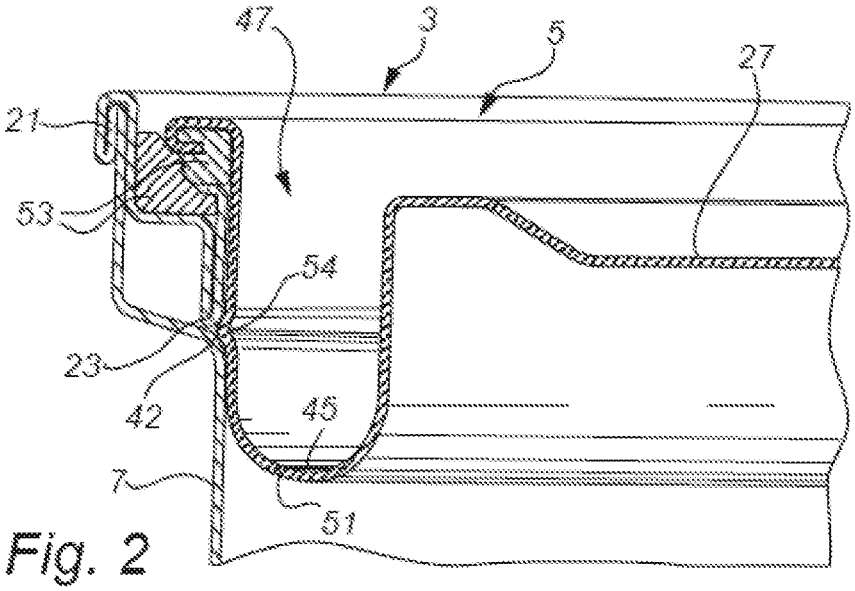
Fig. 2 Prior Art
Figure 3:
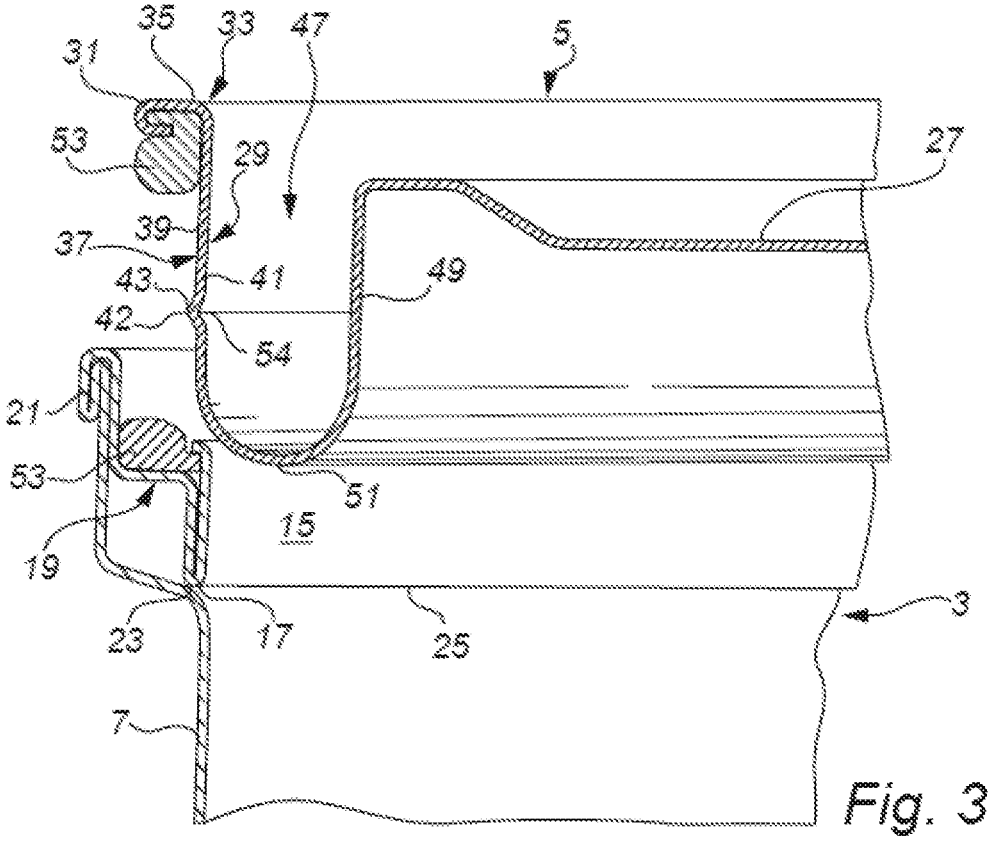
Fig. 3 Prior Art
Figure 4:
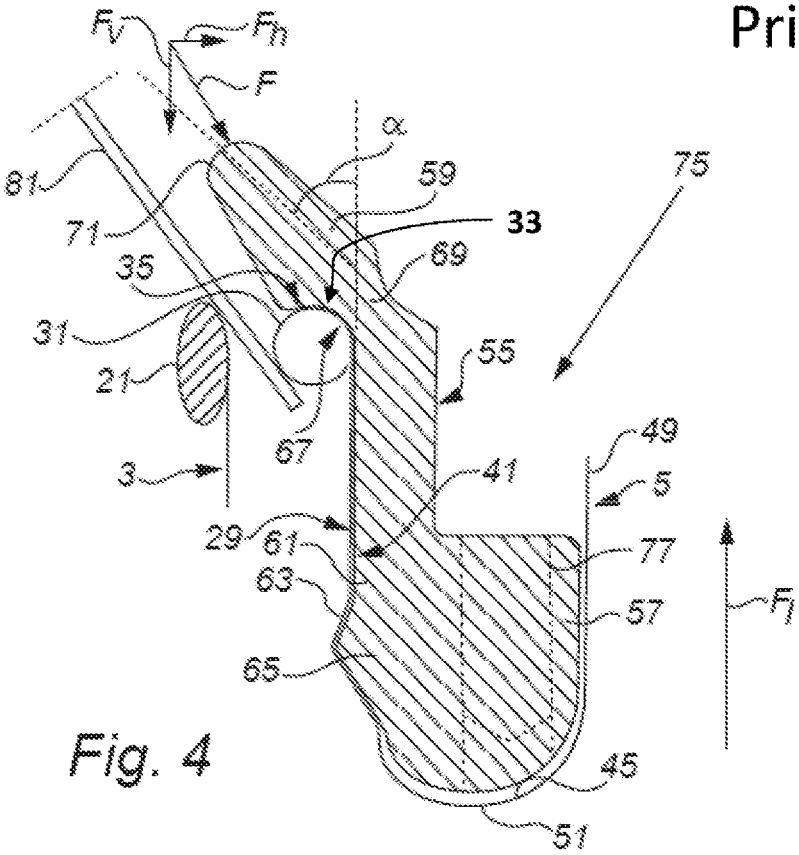
Figure 5:
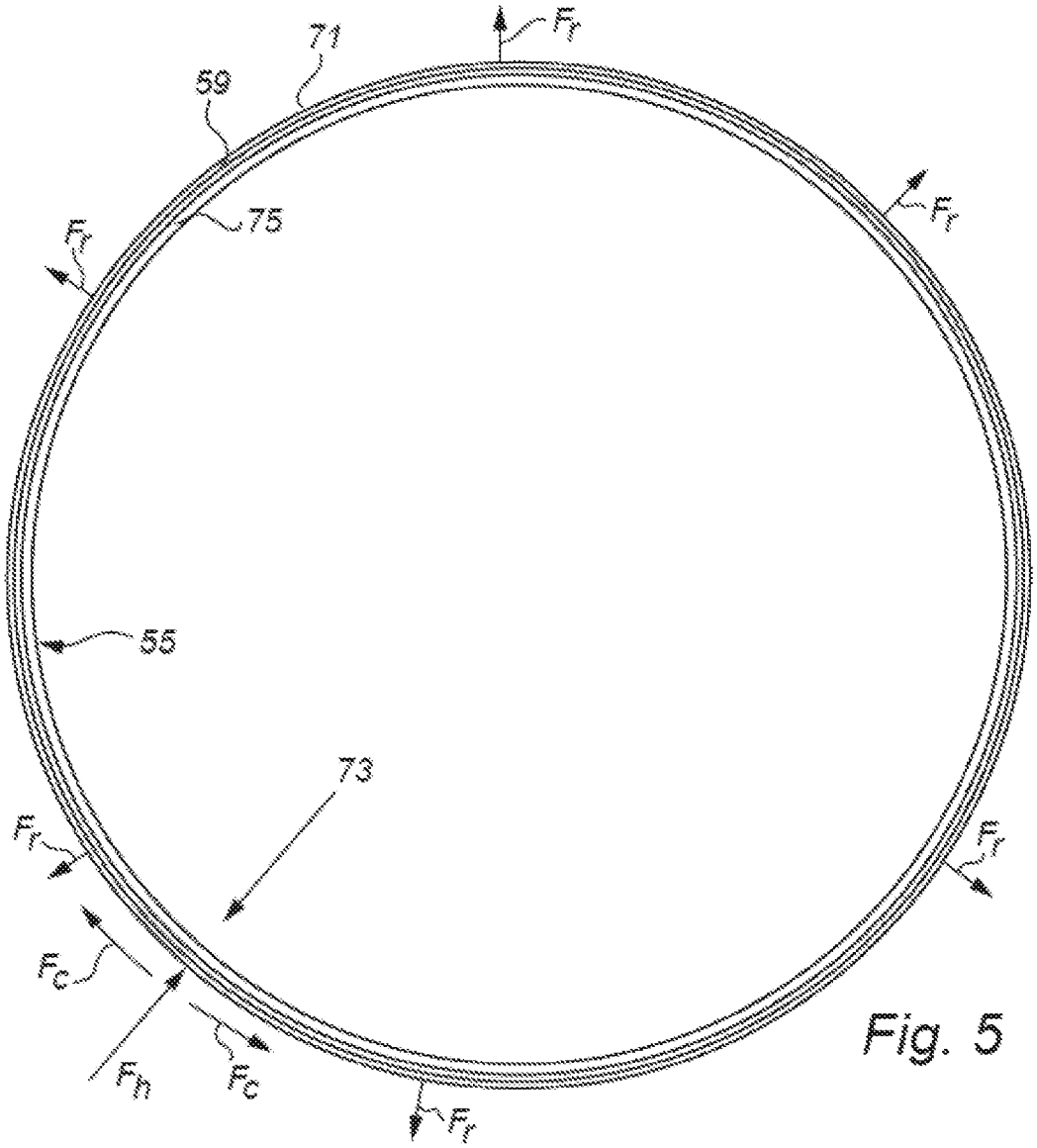
Figure 6:
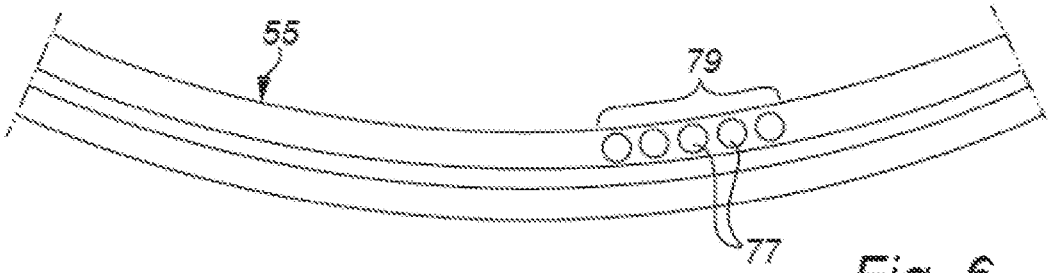

In the following the invention will be described in further detail having reference to the accompanying schematic drawings showing an example of an embodiment, wherein FIG. 1 is a perspective view of a prior art container comprising a container body and a lid, FIG. 2 shows a section along the line II-II in FIG. 1, FIG. 3 is a view corresponding to FIG. 2 but showing the lid lifted from the container body, FIG. 4 shows schematically a securing ring according to the invention applied to the lid of FIGS. 1 to 3, FIG. 5 is a top view of the securing ring, and FIG. 6 is an enlarged section of the securing ring of FIG. 5.

FIGS. 1 to 3 show a container 1 with a container body 3 and a lid 5. The container body 3 has a side wall 7, a bottom 9 and an opening at the top 11 opposite the bottom 9. Further the container body 3 is provided with a handle 13. The container is in FIGS. 1 to 3 shown in an upright position and terms like "up" and "down", etc. as used herein refer to the container in that position unless otherwise is specifically indicated.

The container body 3 has at its opening a closing area with a body-side sealing surface 15 and a body-side securing portion 17, the latter diverging in the downwards direction.

In the embodiment shown the closing area is provided by a ring 19 assembled with the material of the side wall 7 by means of a joint 21. The body-side securing portion 17 is provided by a bend 23 of the material of the ring 19 at a transition 25 between the ring 19 and the side wall 7. In the alternative the closing area might be provided by folding the material of the side wall 7 at the top as it is known in the art.

In the embodiment shown the lid 5 has a central portion 27 surrounded by an outer lid wall portion 29. At an upper end of the outer lid wall portion 29 a rim portion 31 is provided by a more or less tightly rolled edge and an annular ledge 33 with an upturned surface portion 35 is provided by the material of the lid 5 being bend at the upper end of the outer lid wall portion 29.

The outer lid wall portion 29 has an outer side 37, a part of which provides a lid-side sealing surface 39, and an inner surface 41. The outer lid wall portion 29 is provided with a bead 42 which in the embodiment shown is projection outwardly i.e. away from central portion 27 of the lid and thus away from a central vertical axis of the container (not shown). The bead 42 provides a lid-side securing portion 43 diverging in the downwards direction.

At a lower end of the outer lid wall portion 29 a horizontal wall portion 45 is provided.

In the embodiment shown the lid 5 comprises a circumferential trough portion 47 surrounding the central portion 27, said circumferential trough portion 47 being provided by the outer lid wall portion 29, an inner trough wall 49 and a trough bottom 51, the latter thus providing in the present embodiment the horizontal wall portion 45.

At the closing area of the container and at the rim portion of the lid sealing beads 53 are provided as disclosed in WO-A-92/04248 to which document reference is made in that respect.

The body-side sealing surface 15 and the lid-side sealing surface 39 are both annular and extend substantially vertically in the present embodiment.

When the lid 5 is applied to the container body 3 to close the opening of the latter the bead 42 will slide over the body-side sealing surface 15 facilitated by elastic deformation of the material as it is well known in the art and the bead 42 will rest in the small hollow provided by the transition 25 between the ring 19 and the side wall 7, the lid-side securing portion 43 engaging with the body-side securing portion 17 to secure the position of the lid 5, and the lid-side sealing surface 39 will engage with the body-side sealing surface 15 in a sealing manner as it is well known per se in the art and as shown in FIG. 2.

In the embodiment shown the container body 3 and the lid 5 are both made of steel sheet. The inner surface 41 of the outer lid wall portion 29 has a depression 54 opposite the bead 42.

According to the present invention a securing ring 55 is applied to the lid 5 as shown in FIG. 4.

The securing ring 55 comprises a lower portion 57 and an upper flange portion 59. The lower portion 57 is accommodated within the outer lid wall portion 29 and the upper flange portion 59 extends above the annular ledge 33 at an acute angle $\alpha$ (from vertical) which in the embodiment shown is approximately 45°. The lower portion 57 has an outer portion 61 comprising a third securing portion 63 (third to the body-side and lid-side securing portions that is). The third securing portion 63 engages the inner surface 41 of the outer lid wall portion 29 at the level of the lid-side securing portion 43 i.e. an area of said surface directly opposite the lid-side securing portion and immediately adjacent above.

In the embodiment shown the third securing portion 63 comprises a second bead 65 projecting from the outer portion 61. When the securing ring 55 is applied to the lid 5 as shown in FIG. 4 the second bead 65 rests in the depression 54 and secures thereby the securing ring 55 to the lid 5.

It should be understood that in the embodiment shown the securing ring 55 is accommodated within the outer lid wall portion 29 with a tight fit even though a small play is shown only for the sake of illustrating the different parts.

As in the embodiment shown the lid 5 comprises a circumferential trough portion 47 the lower portion 57 is accommodated within said trough portion 47 and in the embodiment shown the lower portion 57 fits around the inner trough wall 49 with a loose fit.

In the embodiment shown the securing ring 55 comprises an annular concave portion 67 situated at a lower inner side 69 of the upper flange portion 59, at which lower inner side 69 the upper flange portion 59 is integral with the lower portion 57. By virtue of the annular concave portion 67 the securing ring 55 may abut on the upturned surface portion 35. Opposite the lower inner side 69 the upper flange portion 59 has a free upper outer side 71.

The invention works as follows within the embodiment described so far:

The container 1 is filled with an amount of a substance, e.g. a liquid such as paint or another chemical, and the lid 5 fitted onto the container body 3 in accordance with normal procedure to close the container. The securing ring 55 is applied to the lid 5 either before or after the lid 5 is applied to the container body 3.

If the filled container falls to the ground in an upside-down position whereby a force F of impact is applied at a circumferential point of impact 73 (FIG. 5) to the free upper outer side 71 of the upper flange portion 59 of the securing ring 55 the following happens:

The force F has a vertical component $F_v$ and a horizontal component $F_h$. The vertical component $F_v$ will tend to press the securing ring 55 downwards and by virtue of the engagement between the securing ring 55 at the annular concave portion 67 and the upturned surface portion 35 the lid 5 will likewise be pressed downwards at the circumferential point of impact 73 to enhance the securing of the seat of the lid 5 in the container body 3 at the circumferential point of impact. The horizontal component will tend to press, at the circumferential point of impact 73, the securing ring 55 towards the centre of the lid, see FIG. 5. Due to rigidity of the securing ring 55 the horizontal component $F_h$ of the force F will be directed circumferentially through the securing ring 55 as indicated by arrows $F_c$ and consequently the securing ring 55 will along its circumference, apart from at the circumferential point of impact 73 exert a radial outwards force $F_r$ against the inner side 41 of the outer lid wall portion 29. This radial force $F_r$ will further enhance the pressure of the lid-side securing portion 43 against the body-side securing portion 17 along the other portions of the circumference than at the circumferential point of impact thus providing enhanced securing of the lid 5 in its seat in the container body 3 along the circumference apart from the circumferential point of impact.

As a reaction to the impact the momentum of the liquid inside the container will result in an upwards force $F_l$ on the inner side of the lid 5 tending to lift the lid 5 off the container body 3. However due to the effect of the securing ring 55 described above the lid 5 is able to withstand a force $F_l$ substantially larger than hitherto possible.

Depending on the actual size and direction of a given force F of impact the securing ring 55 may be pressed off the upturned surface portion 35 and the ledge 33 at the circumferential point of impact to be pressed deeper down into the trough portion to make contact with the trough bottom 51 at the circumferential point of impact. This will only enhance the effects described above.

Apart from the above effect the upper flange portion will per se provide a cushioning effect that enhances the height from which the container may be dropped without leaking as a result of the impact.

The securing ring 55 should have a sufficient strength and rigidity to provide the effects and function described above. Thus a suitable material for the securing ring 55 is polypropylene, but other materials providing a suitable rigidity and strength may be used. Using a material like polypropylene, which apart from having strength and rigidity also has some resilience and elasticity, the upper flange portion will provide a good cushioning effect.

Further though an acute angle α of approximately 45° is used in the embodiment shown different acute angles may be used e.g. up to 80° or 70° from the vertical. Normally the acute angle will be in the range of 35° to 55° from the vertical. However, in combination with the rigidity of the material, the geometry of the profile of the securing ring 55, including the acute angle α should be designed for the upper flange portion 59 to withstand collapsing when the container is dropped from a given maximum height of expected "survival" i.e. a maximum height from which the container is expected to be able to drop without leaking. Withstanding collapse the securing ring 55 will protect an upper rim part of the container body most effectively from direct impact. However even a smaller benefit of the invention may be obtained even in case of the upper flange portion collapsing since the upper flange portion still will absorb part of the energy of the impact.

FIG. 4 shows the profile of the securing ring 55 of the present example of an embodiment. The profile comprises a major annular recess 75, which provides for stacking filled containers as such containers would be stacked without the securing ring 55. Thus the annular recess 75 provides space for accommodating a circumferential joint at the bottom of a container stacked on top of the container shown.

As it appears from FIG. 4 the part of the lower portion 57 below the annular recess 75 has a substantial thickness compared to the parts above of the securing ring 55. To facilitate production of the securing ring 55 by injection moulding the securing ring 55 may be recessed e.g. as indicated in FIGS. 4 and 6 by providing bores 77 in the part of the lower portion 57 below the annular recess 75 thus reducing the local wall thickness in said part. The bores 77 may as indicated in FIG. 4 be provided as through holes, as blind holes, or as a mixture thereof. FIG. 6 shows a small sector 79 provided with bores 77 but it should be understood that preferably such bores 77 are distributed evenly along the entire circumference of the securing ring 55.

When designing recesses for the securing ring 55, care should be taken not to weaken the securing ring to a degree that would ruin the function and effects described above. Thus in an embodiment the outer portion 63 is void of recesses to provide for the second bead 65 to extend continuously circumferentially along the inner surface 41 of the outer lid wall portion 29.

Due to the fact that the upper flange portion 59 extends at an acute angle α above the annular ledge 33 it is possible, even without removing the securing ring 55, to open the container 1 in the usual manner by inserting a screw driver-like tool 81 below the rim portion 33 of the lid 5 as indicated in FIG. 4 and lift the lid 5 from the container body 3 using the screw driver-like tool 81 as a lever. The insertion of a screw driver-like tool 81 may however be facilitated by recessing the upper flange portion, which thus may be interrupt-ed in sectors of e.g. 2 cm along the periphery of the securing ring 55.

The second bead 65 of the securing ring 55 may be omitted. In such case the area of the third securing portion 63 positioned immediately above the second bead 65 as seen in FIG. 4 will by its abutment against the inner surface 41 of the outer lid wall portion 29 provide for the effect of enhancing the pressure of the lid-side securing portion 43 against the body-side securing portion 17 as well as providing for enhancing the pressure of the lid-side sealing surface 39 against the body-side sealing surface 15.

When the second bead 65 is omitted other means may be provided for securing the securing ring 55 to the lid 5. Such other means are e.g. disclosed in a co-pending application by the present applicant and inventor.

Further the provision of the annular concave portion 67 for abutting on the upturned surface portion 35 may be omitted. When this is the case and also the second bead 65 is omitted the securing ring 55 will rest on the trough bottom 51. In such case the securing ring 55 may be provided for supporting containers stacked on top of the present container, since the securing ring 55 will in such case provide a firm support.

The invention claimed is:

1. A container comprising a container body, a lid, and securing means for securing the lid on the container body if the container falls upside down, said container body having a bottom, a side wall and an opening at a top opposite the bottom, said opening having a closing area with a body-side sealing surface, wherein the closing area is unilateral, said lid having a central portion and an outer lid wall portion, said outer lid wall portion being circumferential and surrounding the central portion, a rim portion and an annular ledge being provided at an upper end of said outer lid wall portion, said outer lid wall portion providing on an outer side thereof a lid-side sealing surface, said lid-side sealing surface engaging with said body-side sealing surface, when the lid is applied to the opening of the container body to close the container, the container further comprising as at least part of said securing means a single-element securing ring inserted within said outer lid wall portion, said securing ring comprising a lower portion accommodated within the outer lid wall portion, wherein the securing ring further comprises an upper flange portion outwardly extending from the lower portion above the annular ledge at an acute angle in the range of 35° C. to 80° C. from vertical, wherein the securing ring is a permanent securing ring, whereby the securing ring may remain seated on the lid when the container is opened by the lid being removed.

2. The container according to claim 1, wherein a body-side securing portion extending outwards in a downwards direction is provided at the body-side sealing surface and a lid-side securing portion extending in the downwards direction is provided at the lid-side sealing surface, said lid-side securing portion engaging with said body-side securing portion, when the lid is applied to the opening of the container body to close the container;

said lower portion has an outer portion comprising a third securing portion; and said lower portion is extending at least down to a level of the lid-side securing portion.

3. The container according to claim 2, wherein said third securing portion is arranged for engagement with an inner surface of the outer lid wall portion at the level of the lid-side securing portion.

4. The container according to claim 2, wherein said third securing portion is in engagement with an inner surface of the outer lid wall portion at the level of the lid-side securing portion.

5. The container according to claim 2, wherein the third securing portion extends continuous circumferentially along the inner surface of the outer lid wall portion.

6. The container according to claim 2, wherein the third securing portion comprises a bead projecting outwardly from the outer portion of the lower portion of the securing ring.

7. The container according to claim 2, wherein the third securing portion is provided by a bead projecting outwardly from the outer portion of the lower portion of the securing ring.

8. The container according to claim 2, wherein the securing ring is secured within the outer lid wall portion by engagement between the third securing portion and the inner surface of the outer lid wall portion.

9. The container according to claim 1, wherein the lower portion of the securing ring extends substantially to a horizontal wall portion adjacent the outer lid wall portion.

10. The container according to claim 1, wherein the securing ring comprises an annular concave portion engaging an upturned surface portion of the ledge.

11. The container according to claim 1, wherein the upper flange portion is conical extending upwardly diverging and has a lower inner side connected integrally with the lower portion and a free upper outer side.

12. The container according to claim 1, wherein the lower portion of the securing ring fits within the outer lid wall portion with a tight fit.

13. The container according to claim 1, wherein a circumferential trough portion is surrounding the central portion of the lid, said circumferential trough portion comprising an inner trough wall, a trough bottom and said outer lid wall portion.

14. The container according to claim 13, wherein the lower portion of the securing ring fits around the inner trough wall with a loose fit.

15. The container according to claim 1, wherein the securing ring is recessed.

16. The container according to claim 1, wherein said acute angle is in the range 35° to 70°.

17. The container according to claim 1, wherein said acute angle is in the range 35° to 55°.

18. A container comprising a container body, a lid, and securing means for securing the lid on the container body if the container falls upside down, said container body having a bottom, a side wall and an opening at a top opposite the bottom, said opening having a closing area with a body-side sealing surface, wherein the closing area is unilateral, said lid having a central portion and an outer lid wall portion, said outer lid wall portion being circumferential and surrounding the central portion, a rim portion and an annular ledge being provided at an upper end of said outer lid wall portion, said outer lid wall portion providing on an outer side thereof a lid-side sealing surface, said lid-side sealing surface engaging with said body-side sealing surface, when the lid is applied to the opening of the container body to close the container, the container further comprising as at least part of said securing means a single-element securing ring inserted within said outer lid wall portion, said securing ring comprising a lower portion accommodated within the outer lid wall portion, wherein the securing ring further comprises an upper flange portion outwardly extending from the lower portion above the annular ledge at an acute angle in the range of 35° C. to 70° from vertical.

19. A container comprising a container body, a lid, and securing means for securing the lid on the container body if the container falls upside down, said container body having a bottom, a side wall and an opening at a top opposite the bottom, said opening having a closing area with a body-side sealing surface, wherein the closing area is unilateral, said lid having a central portion and an outer lid wall portion, said outer lid wall portion being circumferential and surrounding the central portion, a rim portion and an annular ledge being provided at an upper end of said outer lid wall portion, said outer lid wall portion providing on an outer side thereof a lid-side sealing surface, said lid-side sealing surface engaging with said body-side sealing surface, when the lid is applied to the opening of the container body to close the container, the container further comprising as at least part of said securing means a securing ring inserted within said outer lid wall portion, said securing ring comprising a lower portion accommodated within the outer lid wall portion, wherein the securing ring further comprises an upper flange portion extending outwardly from the lower portion, above the annular ledge at an acute angle in the range of 35° to 80° from vertical, wherein the lower portion of the securing ring fits within the outer lid wall portion with a tight fit.

* * * * *